US012590458B2

(12) United States Patent
Grabmeier

(10) Patent No.: US 12,590,458 B2
(45) Date of Patent: Mar. 31, 2026

(54) MODIFIED PURLIN CLIP AND KEY SLOTTED PURLIN SYSTEM

(71) Applicant: BlueScope Buildings North America, Kansas City, MO (US)

(72) Inventor: Richard Grabmeier, Kansas City, MO (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 182 days.

(21) Appl. No.: 18/597,142

(22) Filed: Mar. 6, 2024

(65) Prior Publication Data

US 2024/0301691 A1 Sep. 12, 2024

Related U.S. Application Data

(60) Provisional application No. 63/489,193, filed on Mar. 9, 2023.

(51) Int. Cl.
*E04B 7/02* (2006.01)

(52) U.S. Cl.
CPC ..... *E04B 7/024* (2013.01)

(58) Field of Classification Search
CPC ..... E04B 7/024; E04B 7/045; E04B 1/2403; E04B 1/2608; E04B 2001/2412; E04B 2001/2415; E04C 2003/0482
See application file for complete search history.

(56) References Cited

U.S. PATENT DOCUMENTS 3,606,418 A * 9/1971 Buker et al. ..... E04B 7/024 403/376
3,849,012 A * 11/1974 Krouse ..... E04B 1/2403 403/353

(Continued)

FOREIGN PATENT DOCUMENTS

CN 203347024 U * 12/2013
CN 207207706 U * 4/2018

(Continued)

OTHER PUBLICATIONS

Machine translation of CN207207706U (Year: 2025).*

(Continued)

*Primary Examiner* — Ryan D Kwiecinski
(74) *Attorney, Agent, or Firm* — Lathrop GPM LLP; Robert J. Lambrechts

(57) ABSTRACT

A system for assembling continuous overlapping purlins into position upon a plurality of roof beams without having to remove fasteners securing a first installed purlin into position. The system includes a purlin clip with a lower flange and an upper flange. The second purlin overlapping the first purlin, the first and second purlins each comprising first and second longitudinally disposed ends and at least one keyhole disposed within each longitudinally disposed end. The purlin clip is mounted with fasteners to a roof beam proximate the second end of the first purlin and a primary fastener is passed through the at least one keyhole of the first purlin into the secondary fastener, wherein the primary fastener is not fully received into the secondary fastener and remains available for hanging thereon of the keyhole in the first end of the second purlin.

14 Claims, 7 Drawing Sheets

(56) References Cited

U.S. PATENT DOCUMENTS

| | | | | |
|---|---|---|---|---|
| 5,038,529 | A * | 8/1991 | Conley | E04B 7/024 52/22 |
| 6,709,211 | B1 * | 3/2004 | Knecht | F16B 35/06 411/176 |
| 6,840,021 | B1 | 1/2005 | Ashmore et al. | |
| 2006/0137278 | A1 * | 6/2006 | Heady | E02D 37/00 52/514 |
| 2008/0290233 | A1 | 11/2008 | McCoubrie | |
| 2010/0319277 | A1 * | 12/2010 | Suarez | F24S 25/636 52/173.3 |
| 2013/0036685 | A1 | 2/2013 | Suarez et al. | |
| 2013/0146554 | A1 | 6/2013 | Berry et al. | |
| 2016/0118726 | A1 | 4/2016 | Schaefer et al. | |
| 2024/0011309 | A1 * | 1/2024 | McArthur | E04G 21/1841 |

FOREIGN PATENT DOCUMENTS

| | | | | | |
|---|---|---|---|---|---|
| CN | 208501913 | U | | 2/2019 | |
| EP | 3581726 | A1 | * | 12/2019 | E04B 7/045 |
| EP | 4390003 | A1 | * | 6/2024 | E04C 3/07 |
| FR | 2705706 | A1 | * | 12/1994 | E04B 1/24 |
| GB | 2457712 | A | * | 8/2009 | E04B 1/2608 |
| JP | 2000336768 | A | * | 12/2000 | |
| JP | 2013218833 | A | * | 10/2013 | |

OTHER PUBLICATIONS

Machine translation of CN203347024U (Year: 2025).*
PCT Application No. PCT/US2024/018728, International Search Report and Written Opinion, dated Oct. 9, 2024.

* cited by examiner

MODIFIED PURLIN CLIP AND KEY SLOTTED PURLIN SYSTEM

CROSS REFERENCE TO RELATED APPLICATIONS

This application claims priority from U.S. Provisional Application No. 63/489,193 filed Mar. 9, 2023. The content of this application is incorporated herein by reference in its entirety.

FIELD OF THE DISCLOSURE

This disclosure relates to a system for improving the efficiency of installation of purlins to roof beams.

BACKGROUND

As with all industry across the globe there is an ongoing need to improve the speed and efficiency at which construction takes place. The ability to reduce the time necessary for erection of buildings to in-turn reduce labor costs and therefore overall cost of construction has taken center stage. Also, systems and equipment that enhances safety of workers that must work at elevated heights is also increasingly important.

Purlins play a crucial role in the construction industry, particularly in the context of roofing systems. These horizontal structural elements are typically placed on the principal rafters of a roof to provide support for the roof covering, such as metal sheets or other roofing materials. Purlins help distribute the load of the roof evenly, ensuring stability and preventing sagging or buckling. They also contribute to the overall structural integrity of a building by transferring roof loads to the primary structure. Purlins come in various materials, including wood, steel, or aluminum, and their design is influenced by factors such as the span of the roof, roof covering weight, and local building codes.

Installing long span purlins in construction can pose several challenges due to the increased span length and the specific requirements associated with supporting roofing systems over larger distances. Long span purlins must withstand significant loads over their extended length. Ensuring structural integrity becomes critical to prevent issues such as sagging or deflection. Engineers need to carefully design and analyze the structural elements to meet load-bearing requirements. The choice of materials for long span purlins becomes crucial. Depending on the span length and load-bearing requirements, materials like steel or other high-strength alloys may be necessary. Material selection affects both the structural performance and the overall cost of the project. Long purlins may be challenging to transport and handle on the construction site. Specialized equipment or transportation methods may be needed, and careful handling is essential to prevent damage to the purlins during transit and installation.

Installing long span purlins can be more complex than shorter spans. Precision in alignment and spacing is crucial to maintain the structural integrity of the roofing system. Specialized installation techniques or equipment may be required to ensure accurate placement. Ensuring secure and effective connection points between the purlins and the primary structure is vital. Achieving precise alignment and tolerances becomes more challenging with longer purlins. Any misalignment during installation can lead to structural issues and affect the overall roofing system's performance. Adequate fastening methods must be employed to withstand the forces acting on the purlins, especially in regions prone to high winds or seismic activity.

Long span purlin installations must comply with local building codes and regulations. Ensuring that the design and installation meet these standards is essential for the safety and legality of the construction project. Longer purlins may be more expensive both in terms of material and installation costs. Balancing the benefits of longer spans with the associated costs is a crucial consideration in construction projects. Addressing these challenges requires careful planning, engineering expertise, and adherence to industry best practices to ensure the successful installation of long span purlins in construction projects.

Currently, continuous purlins must be fully anchored into position by a plurality of fasteners before moving onto the immediately adjacent overlapping purlin. Selecting appropriate fastening methods is essential for securing long span purlins. Bolts, screws, or other connectors must be chosen based on factors such as material strength, corrosion resistance, and case of installation. In some cases, specialized fastening systems may be required. Recognizing that some purlins can be up to 40 feet in length they can be very cumbersome and unwieldy. It is this cumbersome and unwieldy nature that requires the purlins to be fastened into position so that they do not flex undesirably. Shorter span purlins can also be equally unwieldy particular in high wind scenarios, so the clip, system and methods disclosed herein are equally applicable to shorter span purlins. What is needed is a system or method to allow securement into position of the immediately adjacent continuous purlin without having to remove the already installed fasteners for securing the first installed purlin into position.

SUMMARY

Disclosed herein is a system for installing continuous purlins without having to remove fasteners that are securing the first purlin into position. The roof system disclosed herein is supported roof beams (also known as a "rake beam" when positioned at the edge of the roof). The roof or rake beams are supported at the upper ends of vertical steel columns elevating them above ground level. Sitting atop the roof or rake beams are purlins. The roof purlins are cold-formed steel structural members which directly support the roof system, typically spaced at five-foot centers.

These components are produced for large buildings that span substantial distances and will utilize many "continuous purlins" spanning across the beams. A "continuous purlin condition," is when two separate purlins are overlapped and bolted together such that they act structurally as if they are one continuous structural member. For purposes of this disclosure, the lap occurs over the roof beams.

Using currently utilized roof installation methods, the first purlin must be bolted to each roof beam in order to stabilize it in position (these metal purlins typically range in length from 24'-35' and are unwieldy) and then when the next (second) purlin is to be installed overlapping the first purlin the fastening hardware (structural bolts) in the overlapping region must presently be removed to allow the second purlin to be nested into the first purlin and aligned with fastening holes. The fasteners are then reinstalled securing the overlapping purlins to the beam and to one another. While not a complicated installation process it is time consuming to undo numerous fasteners for many overlapping purlins across an entire roof and then to refasten the fasteners in position once the overlap is completed.

The system disclosed herein reduces the time (and manual effort) needed to install these continuous purlins. A purlin clip in the field is bolted to the roof beam disposed below it. The critical detail is that one or more secondary/female fasteners (e.g., nuts that are internally threaded) are secured to the backside of the upper member of the purlin clip. Standard nuts may be welded to the backside of the purlin clip; however, it is more likely that specialized hardware such as self-clinching nuts or cage nuts would be employed because of the noxious fumes generated with the welding of a nut to a galvanized steel purlin clip.

In addition to changes to the purlin clip, at least one keyed slot is also punched into the longitudinally opposed ends of each purlin that allows the installers to pass a primary/male fastener into the female/secondary fastener located on the rear face of the purlin clip. Leaving the head of the male fastener slightly backed away from the face of the clip allows the installation team to pass the head of the somewhat backed out male fastener through the wide opening in the keyhole of the purlin, drop the purlin downwardly and capture the purlin on the narrowed portion of the keyhole.

The system disclosed herein reduces the time (and manual effort) needed to install these continuous purlins. The critical detail is that one or more secondary/female fasteners (e.g., nuts) are secured to the backside of the upper member of the standard purlin clip. While welding of nuts, or female fasteners, to the backside of the purlin clip is contemplated by this disclosure it is more likely that hardware such as self-clinching nuts or cage nuts are to be employed because of the noxious fumes generated with the welding of a nut to a galvanized steel purlin clip.

In addition to changes to the purlin clip, at least one keyed slot, as illustrated is also punched into each purlin that allows the installers to pass a threaded primary/male fastener into the secondary/female fastener on the backside of the purlin clip. Leaving the head of this threaded fastener slightly backed away from the face of the clip allows the installation team to pass the head of the slightly backed out primary fastener through the wide opening in the keyed slot of a purlin, drop the purlin downwardly and capture the purlin on the narrowed portion of the keyed slot.

The male fastener may then be advanced inwardly, but not fully received into the secondary fastener, to temporarily secure the purlin to the clip until the second, lapping, purlin is installed by hanging the second purlin's keyhole over the primary/male fastener in the same manner as performed with the first purlin. Once the second purlin is captured the male fastener may be fully received into the female fastener and a supplemental anchor fastener is preferably employed to secure the purlins together even more rigidly. Lastly, fasteners, typically two on each end of the purlins, are used to increase the rigidity of the continuous purlins spanning the structure.

This process of mounting, or resting, the second end of the first purlin on the male fastener while first end of the second continuous purlin is mounted to the first purlin is the key component of the disclosed purlin clip, system, and method. Once the second purlin keyhole is mounted onto the male fastener, the threaded fasteners ancillary to the instant male fastener can be tightened. Next, other continuous purlin overlays upon roof beams can be addressed in the same manner until all purlins are mounted to their respective purlin clips which in turn are mounted to the roof beams.

Accordingly, an object of the disclosed purlin clip, system and method is to reduce field labor and cost at purlin laps by eliminating the need to fully unbolt the previously installed purlin before installing the next lapping purlin.

Another object of the disclosed purlin clip and system is the benefit it provides for modular style erection of building, where two roof frames have roof purlins bracing, or liner installed before being lifted into place as this yields savings in labor and reduced need for lift equipment and less time working at heights.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
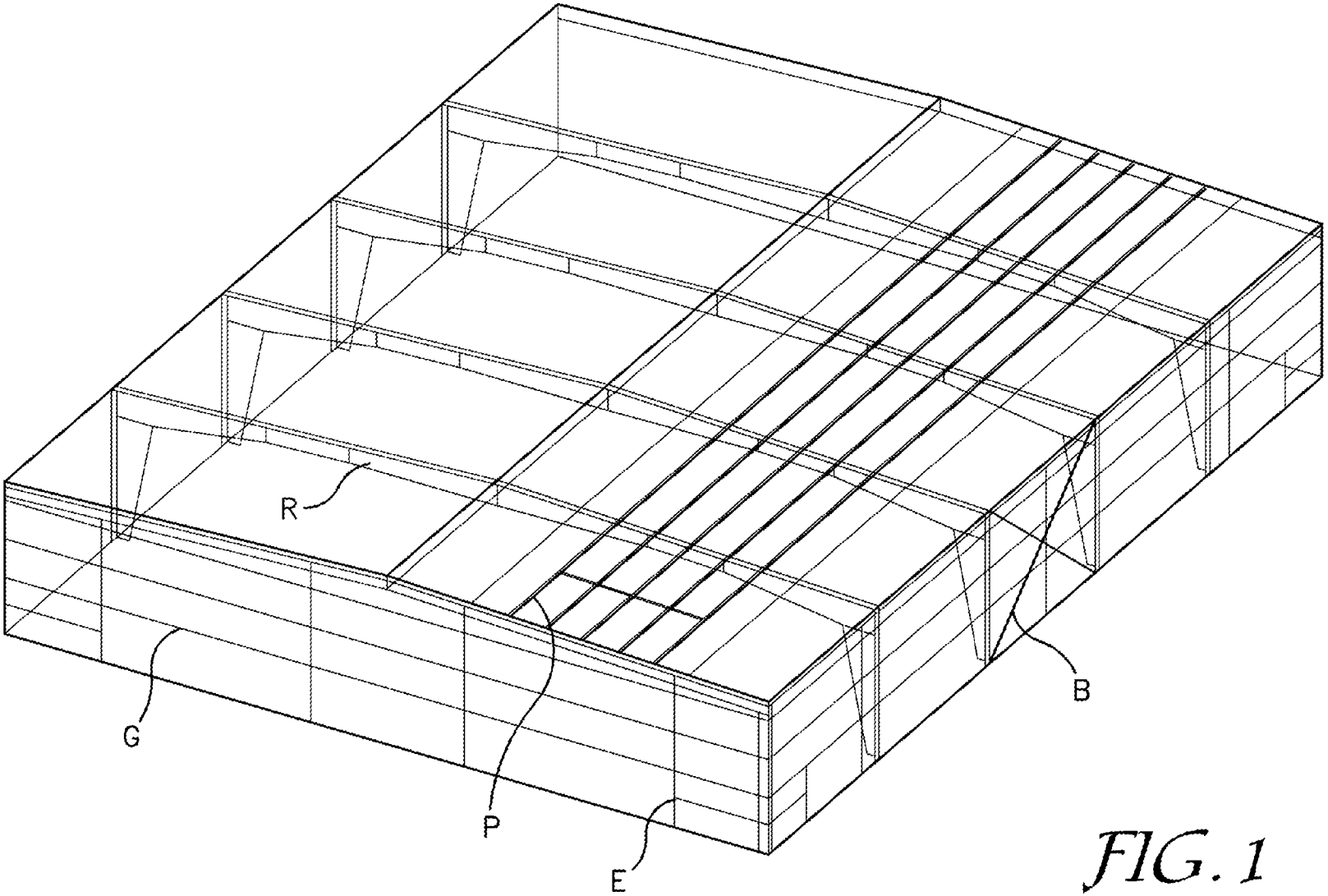
FIG. 1 illustrates a skeleton of a metal framed building identifying various structural elements to include purlins and steel rafters.
Figure 2A:
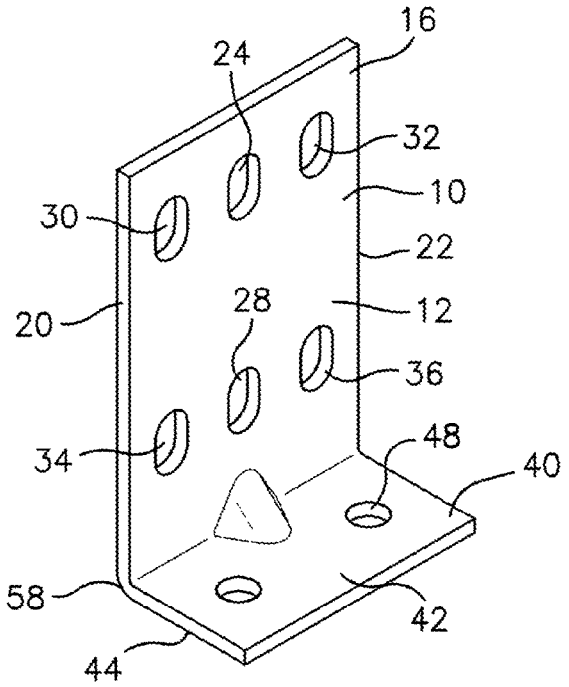
FIG. 2A illustrates an isometric view of an embodiment of a purlin clip in isolation.
Figure 2B:
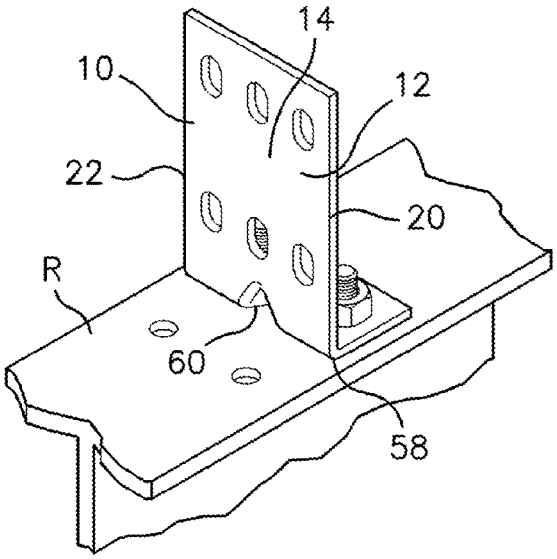
FIG. 2B illustrates a front isometric view of an embodiment of a purlin clip mounted to a roof beam.
Figure 2C:
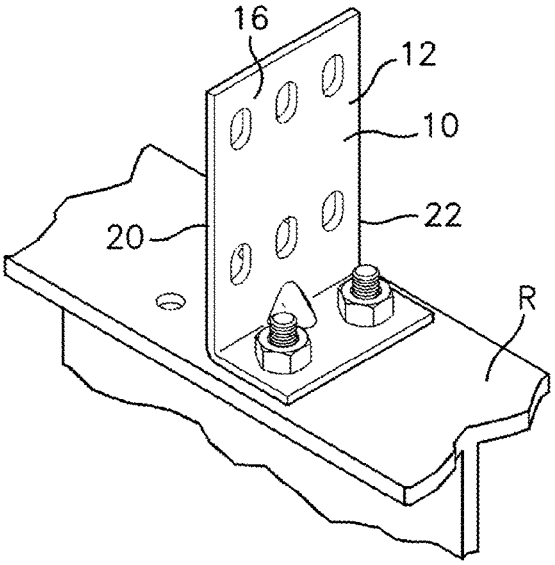
FIG. 2C illustrates a rear isometric view of the embodiment of a purlin clip mounted to the roof beam.

FIG. 1 illustrates the various structural elements of a metal framed building to include roof beams R, girts G, purlins P, end posts E and side braces B. FIG. 2A illustrates an exemplary purlin clip 10 in isolation while FIG. 2B illustrates the front face of the purlin clip 10 mounted atop a roof beam R. FIG. 2C illustrates the rear face of the purlin clip 10 mounted to the roof beam R.

Figure 3:
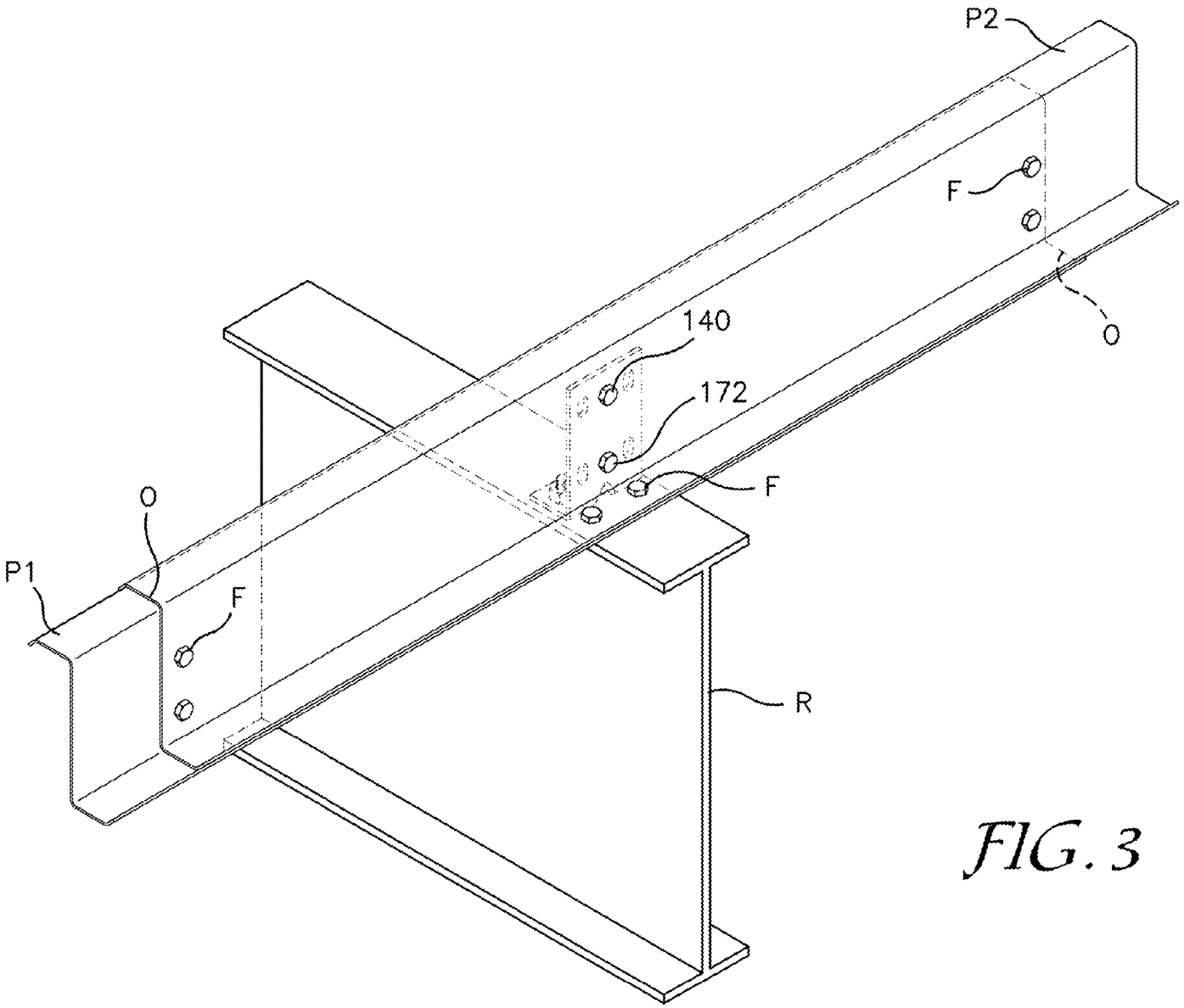
FIG. 3 illustrates a continuous purlin connection disposed atop a roof beam with a purlin clip in phantom view.

FIG. 3 illustrates a continuous (overlapping) purlin P1, P2 atop a roof beam R and illustrates in phantom the purlin clip 10 with fasteners F securing the two overlapped purlins P1, P2 to the roof beam R. Also illustrated are two fasteners F at each end of the overlap O of the purlins. These fasteners F provide increased engagement between the overlapping purlins P1, P2 thereby enhancing the rigidity of the continuous purlin.

FIGS. 2A, 2B, 2C and 4 illustrate an embodiment of a purlin clip 10 for assembling the longitudinally overlapping first and second purlins P1, P2 each with keyholes atop a roof beam. The purlin clip 10 as disclosed herein includes an upper member 12 with a front face 14, a rear face 16, opposed lateral edges 20, 22 and at least one opening 24, and in a preferred embodiment a total of six openings, in the upper member 12. In the preferred embodiment, the upper member 12 includes a center upper opening 24, a center lower opening 28, a first set of side openings 30, 32 and a second set of side openings 34, 36. The upper member 12 is preferably metal plate.

The center upper and lower openings 24, 28 are directed to securing the continuous purlins into position while the two sets of side openings 30, 32, 34, 36 are utilized when purlins P1, P2 are butt joined instead of in an overlapped continuous configuration. When purlins are butt joined an end of each purlin P1, P2 is fastened to the purlin clip 10 at one set of side openings 30, 32 or 34, 36 on the purlin clip 10. These side openings may be either circular or elliptical in configuration with an elliptical configuration being preferred because of the increased case and efficiency of alignment with the openings in the purlins P1, P2. When butt joined the opposed ends of the first and second purlins P1, P2 do not overlap and are separated by approximately 0.25 inches. While this disclosure is not directed to butt joined purlins, the purlin clip 10 in the disclosed configuration is capable of supporting butt joined purlins.

Figure 4:
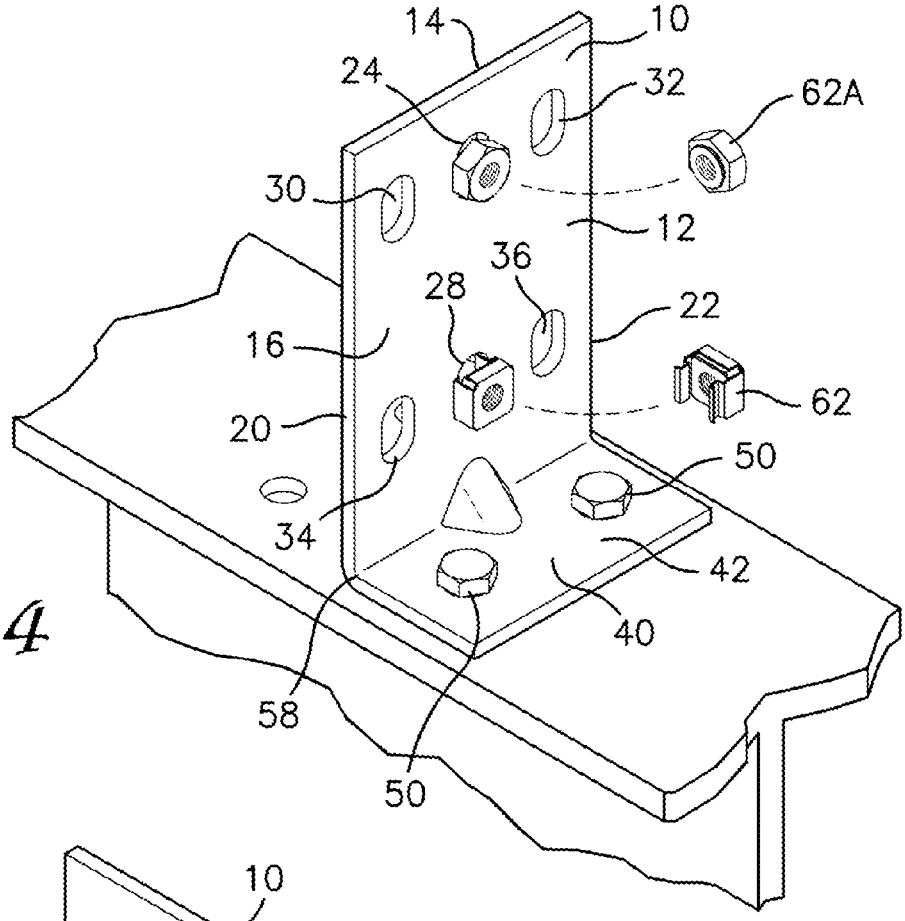
FIG. 4 illustrates a rear face of a purlin clip with secondary or female fasteners secured to the backside of the upward flange of the clip.

As further illustrated at FIGS. 2A and 4, the purlin clip 10 also includes a lower member 40 with an upper face 42 and a lower face 44. The lower member 40 includes at least one opening 48, and preferably two openings, for receiving fasteners 50 to secure the purlin clip 10 to a roof beam R. The purlin clip 10 also includes an arcuate member 58 connecting the upper member 12 to the lower member 40 and the arcuate member is preferably of a metallic composition fully consistent with the composition of the upper and lower members 12, 40 and seamlessly connected thereto. The arcuate member 58 preferably provides an orthogonal transition from the upper member 12 to the lower member 40; however, there may be instances where the transition from upper to lower member is not fully orthogonal, for example canted at 70 degrees as opposed to 90 degrees, and that configuration is also contemplated herein. As further illustrated at FIG. 2B, the arcuate member 58 comprises an indentation 60 to enhance the stiffness of the arcuate member 58.

The indentation 60 is preferably located mid-span between the two opposed edges 20, 22 of the purlin clip 10 to optimize the capacity of the purlin clip 10 to resist bending loads being applied to the upper and lower members 12, 40. The purlin clip 10 is preferably fabricated from steel and of sufficient thickness, width, and height to accommodate the roof design parameters and to support the loads applied to the purlin clip 10 without the clip experiencing deformation. The upper member 12, lower member 40 and arcuate member 58 are preferably all fabricated from a single continuous steel plate that is bent at the arcuate member 58 effectively separating the upper and lower members 12, 40 into two separate and distinct regions. While galvanized steel is the preferred fabrication material, it is contemplated by this disclosure that stainless steel, non-ferrous metals, composites and engineered plastics among other materials may be used in the production of the purlin clip 10.

In a preferred embodiment, the upper member 12 extends longitudinally approximately 3-5 times that of the longitudinal span of the lower member 40. The lower member 40 needs only sufficient extension outward from the arcuate member 58 to allow for placement of fasteners to secure the purlin clip 10 to the roof beam R. The upper member 12, however, requires sufficient height to accommodate purlins P1, P2 that are of considerable lateral span therefore requiring a height that can require in the range of 5-8 times the outward span of the lower member 40 from the arcuate member 58.

The purlin clip 10 as disclosed herein and as illustrated at FIG. 4 employs a female fastener 62A mounted to the rear face 16 of the upper member 12. The female fastener 62A is positioned directly over the circular or elliptical upper opening 24 in the upper member 12. In a preferred embodiment the female fastener 62A is mounted to the upper member without needing to weld the fastener 62A to the upper member 12. Exemplary fasteners 62A for utilization in this context are cage nuts and self-clinching nuts. The types of female fasteners 62A, as illustrated at FIG. 4, may be pressed into and securely retained in the opening 24 of the purlin clip 10 without the need for welding, which can create toxic fumes, or adhesives which may provide insufficient holding power.

A second opening 28 in the purlin clip 10 that is positioned lower than the first opening 24 serves ultimately to further anchor the purlins P1, P2 to the purlin clip 10 once the purlins P1, P2 are mounted atop the male fasteners that are received into the female fasteners 62, 62A. The second opening 28 may be either circular or elliptical, as clinch nuts generally require a circular opening while cage nuts require an elliptical opening. The second opening 28 is disposed in the range of about 3-8 inches below the first opening 24. As with the first opening 24, a female fastener 62 is mounted to the rear face 16 of the upper member 12. The female fastener 62 as detailed above is preferably not welded to the rear face 16 as welding to stainless steel of the purlin clip 10 can create toxic fumes. Cage nuts and self-clinching nuts are preferable from both a safety and speed of installation perspectives.

Figure 6:
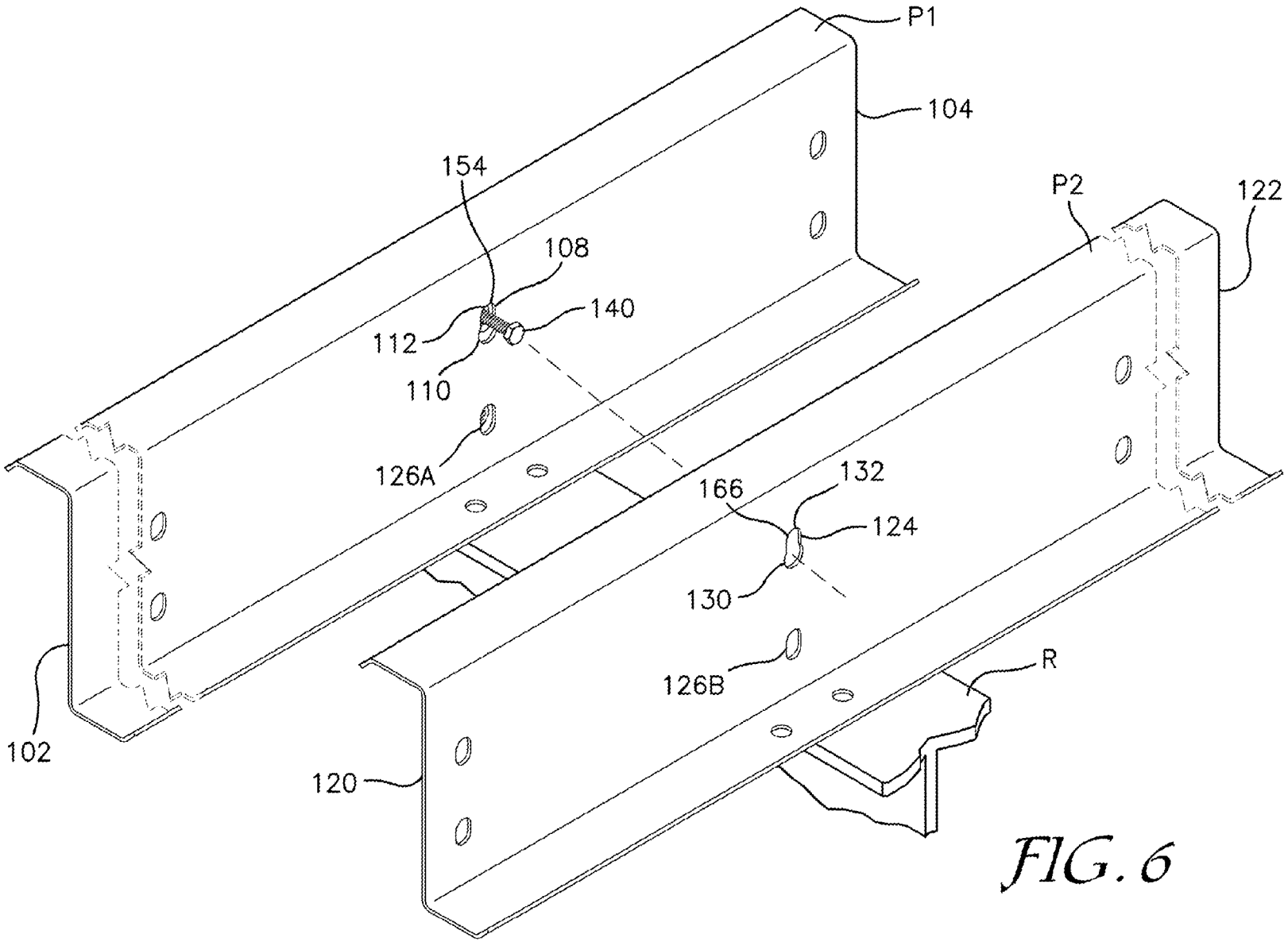
FIG. 6 illustrates overlapping continuous purlins with a keyhole through which the male fastener supports the first purlin and awaits mounting of the second purlin upon the male fastener.
Figure 8:
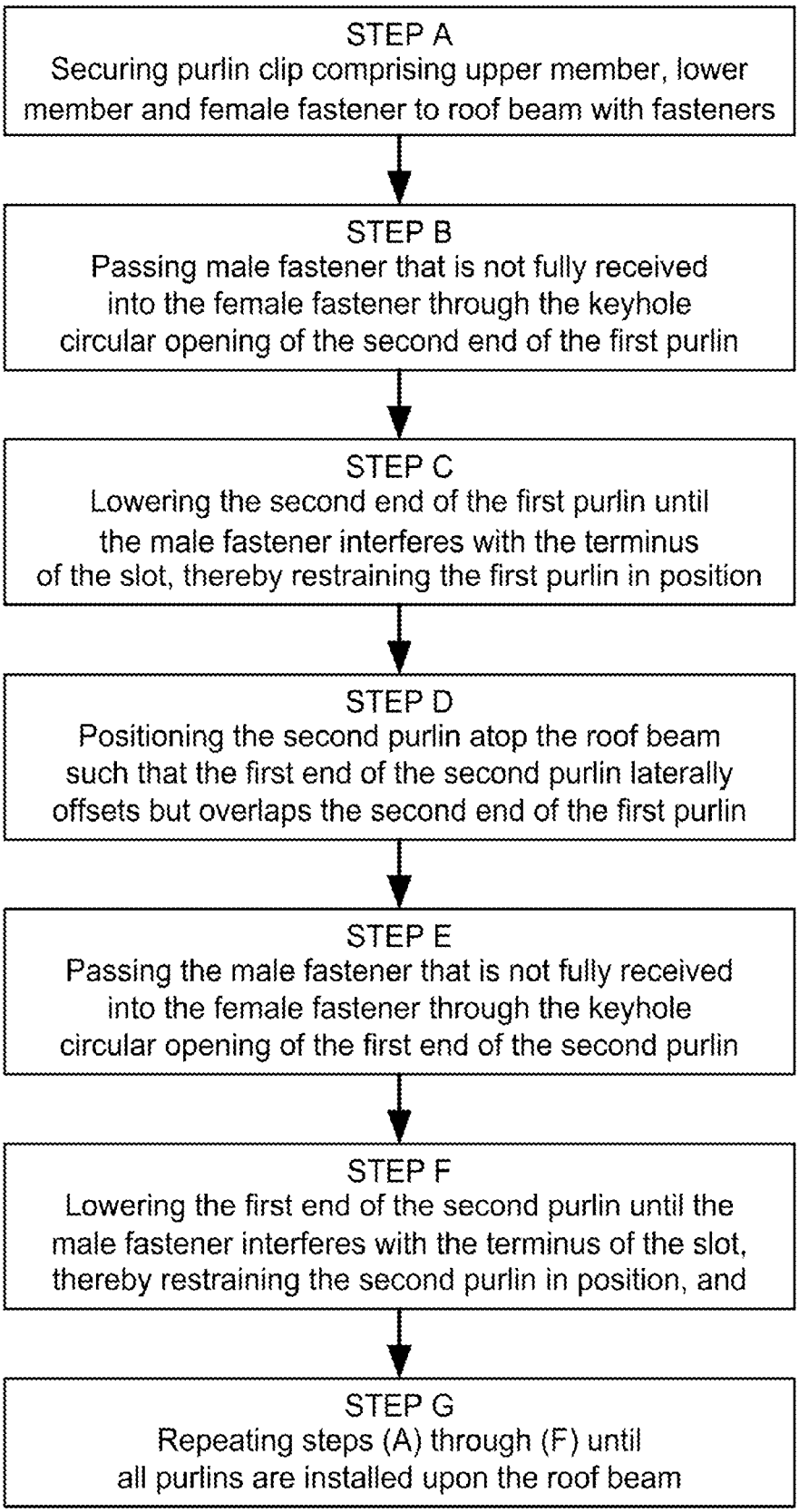
FIG. 8 illustrates a process flow diagram of the method of assembly of the continuous purlin.

Now that the structure of the innovative purlin clip 10 has been described, the method of utilization of the purlin clip 10 to expedite the assembling of continuous purlins P1, P2 upon a roof structure shall be described. FIG. 6 illustrates the placement of the first purlin P1 upon the roof beam R in preparation for hanging the first purlin on the male fastener. FIG. 8 illustrates a method flow diagram for the installation of a continuous purlin consisting of P1 and P2 upon a building structure without requiring removal of fasteners securing the first purlin P1 into position. The method includes the purlin clip 10 detailed above with the lower member 40 with at least one opening 48 therein for securing the lower member 40 with at least one fastener 50 to the roof beam R as described at STEP A in FIG. 8.

The method also includes utilizing a purlin clip 10 with an upper member 12 with a front face 14 and a rear face 16 and at least one opening 24. A female fastener 62 is secured to the rear face 16 of the upper member 12 and is disposed over the opening 48. As best illustrated at FIG. 6, the first purlin P1 includes longitudinally opposed first and second ends 102, 104 and a keyhole 108 proximate each end 102, 104. Each of the keyholes 108 of the first purlin P1 further include a circular opening 110 and a slot 112 extending outwardly from the circular opening 110. A second purlin P2 includes a first end 120 and a second end 122 and keyholes 124 proximate each of the first end and second ends 120, 122. The keyholes 124 of the second purlin each include a circular opening 130 and a slot 132. To secure the purlins P1, P2 to the purlin clip 10 also requires the use of a male fastener 140.

The method disclosed herein further requires passing of the male fastener 140 that is not fully received into the female fastener 62 through the keyhole circular opening 110 of the second end 104 of the first purlin P1 as detailed at STEP B. Not fully received, as illustrated at FIG. 6, means that if the male fastener 140 is for example a threaded fastener, then the male fastener 140 is not threaded all the way into the female fastener 62, i.e., it extends part way out and is not all the way passed into the female fastener. STEP C requires lowering the second end 104 of the first purlin P1 until the male fastener 140 interferes with the terminus 154 of the slot 112 thereby restraining the first purlin P1 in position upon the male fastener 140.

STEP D requires positioning the second purlin P2 atop the roof beam R such that the first end 120 of the second purlin P2 laterally offsets but longitudinally overlaps the second end 104 of the first purlin P1. Once STEP D is completed, the method requires passing the male fastener 140 that is not fully received into the female fastener 62 through the keyhole circular opening 124 of the first end 120 of the second purlin P2 as disclosed at STEP E. Upon completion of STEP E, the second purlin P2 is lowered until the terminus 166 of the slot 132 of first end 120 of the second purlin P2 interferes with the male fastener 140, thereby restraining the second purlin P2 in position and completing STEP F.

Figure 7:
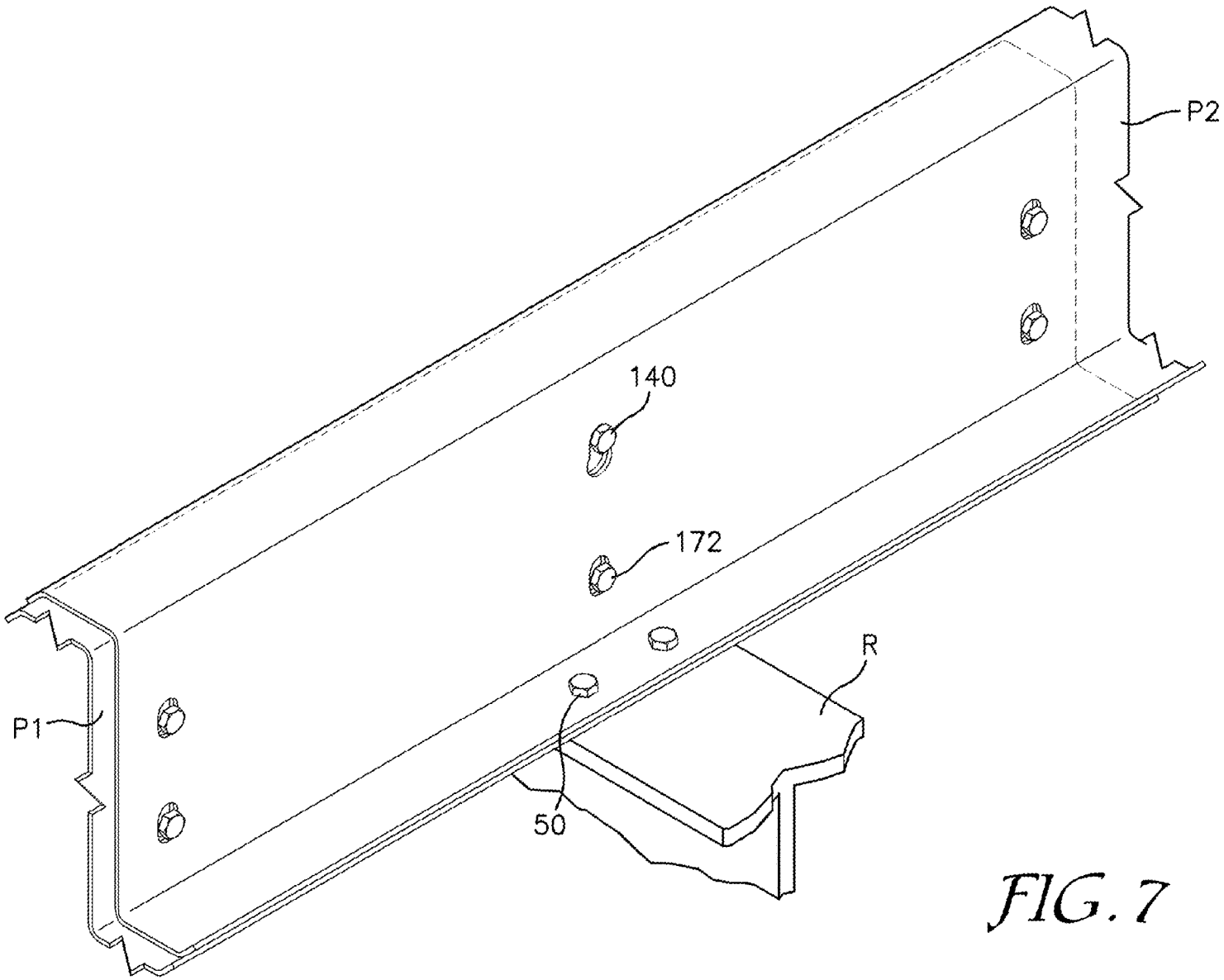
FIG. 7 illustrates a continuous purlin connection atop the roof beam with the male fastener residing in the slot of the keyhole.

Next, the male fastener 140 is fully received within the female fastener 62 and a tightening against both purlins P1, P2 occurs thereby locking them into position atop the roof beam R. As illustrated collectively at FIGS. 3, 6 and 7, a supplemental male fastener 172 is advanced into the openings 126A, 126B beneath the keyholes 108, 124 of both purlins P1, P2. This supplemental fastener 172 is received into a supplemental female fastener 62, as illustrated at FIG. 4, positioned against the rear face 16 and over the second opening 28 in the purlin clip 10. Finally, as set forth at STEP G, the previously related method steps are repeated for all continuous purlin connections across the roof structure.

Also disclosed herein is a system, as illustrated following final assembly at FIG. 1, for assembling first and second longitudinally overlapping purlins P1, P2 into position without requiring removal of fasteners securing the first purlin P1 into position atop the roof beam R. As with the disclosed method of assembly detailed above, the disclosed system requires a roof beam R and preferably a plurality of purlin clip 10*s* and purlins P1, P2 as well as various fasteners.

The purlin clip 10 as previously detailed and as illustrated at FIGS. 2A, 2B and 2C includes a lower member 40 with at least one opening 48 therein, and preferably two, for securing the lower member 40 with a lower member fastener 50 to the roof beam R. The purlin clip 10 also includes an upper member 12 with a front face 14, a rear face 16, opposed side edges 20, 22 and at least one opening 24. In a preferred embodiment there are a total of six openings in the upper member 12. The preferred embodiment includes at least one opening 24 and preferably five additional openings to include a center lower opening 28, a first set of side openings 30, 32 and a second set of side openings 34, 36. The two sets of side openings 30, 32 and 34, 36 are used, as previously detailed, for butt joined purlins P1, P2.

Figure 5:
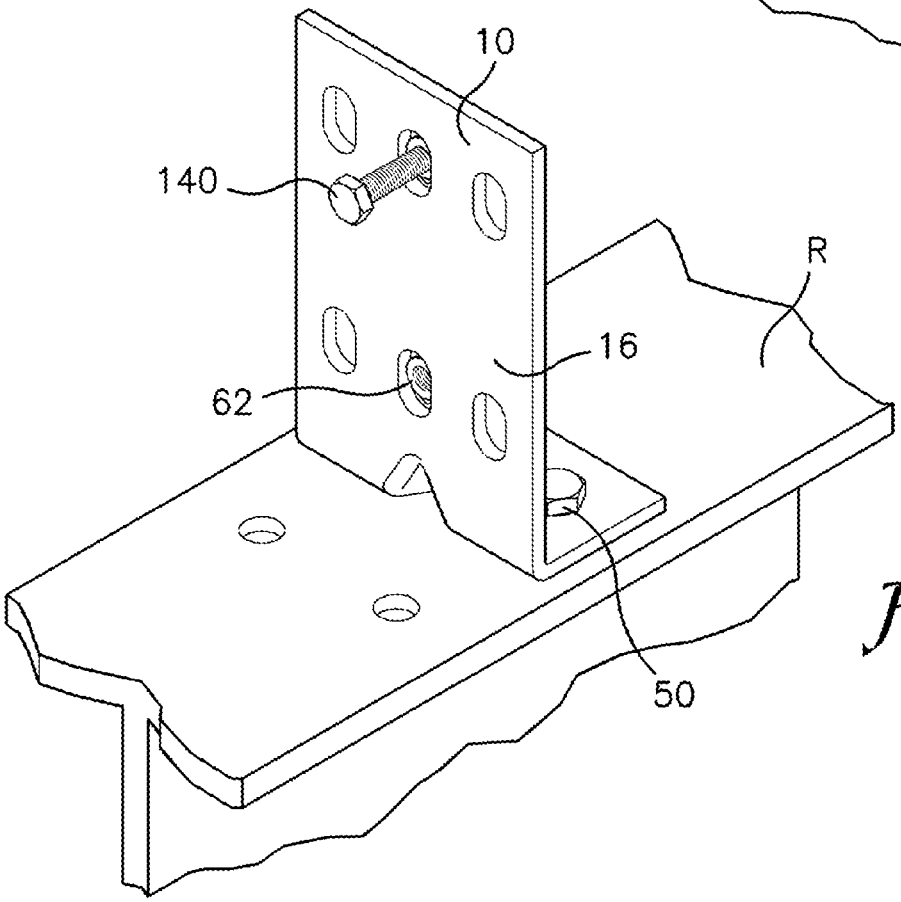
FIG. 5 illustrates a front face of the purlin clip with a single primary or male fastener partially threaded into the female fastener.

As illustrated at FIGS. 2A, 2B and 2C, disposed between the upper 12 and lower members 40 is an arcuate member 58 along with an indentation 60 to enhance the structural rigidity of the purlin clip 10. Additionally, a female fastener 62 is secured to the rear face 16 of the upper member 12 over the opening 48 therein. As illustrated at FIG. 5, the female fastener 62 is operable to receive a threaded male fastener 140 upon which the second end of the first purlin P1 and the first end of the second purlin P2 will be mounted during the continuous purlin installation process.

As illustrated at FIG. 6, the disclosed system includes a first purlin P1 with first and second longitudinally opposed ends 102, 104 and at least one keyhole 108 proximate each end of the purlin. The keyholes 108 of the first purlin P1 comprise a circular opening 110 and a slot 122 extending outwardly from the circular opening. A second purlin P2 includes a first end 120 and a second end 122 and a keyhole 124 proximate each of the first end and second ends 120, 122. The keyholes 124 of the second purlin each include a circular opening 130 and a slot 132. To secure the purlins P1, P2 to the purlin clip 10, as previously noted, requires the support of a male fastener 140 that is not fully threaded into the female fastener 62, 62A mounted to the purlin clip 10.

A male fastener 140 starting from the front face 14 of the upper member 12 is operable for partial receipt into the female fastener 62 thereby allowing the male fastener 140 to pass through the keyhole circular opening 110 of the second end 104 of the first purlin P1 permitting the second end 104 of the purlin P1 to drop fully into the slot 122 of the keyhole 110 suspending the first purlin P1 in position against the male fastener 140 received into the purlin clip 10 that is mounted atop the roof beam R. The installer of the continuous purlins then moves the male fastener 140 through the keyhole circular opening 130 in the first end 120 of the second purlin P2 and the purlin is slid downward resulting in the male fastener 140 sliding fully into the slot 132 contacting the terminus 166 at which time the male fastener 140 is maintaining in position both the second end 104 of the first purlin P1 and the first end 120 of the second purlin P2.

The utilization of the disclosed purlin clip 10 and the methods and systems disclosed herein allow quicker erection or installation of the roof structure of a prefabricated building. It is anticipated that the disclosed clip, method of installation and system will reduce labor costs which is one of the most significant expenses in construction projects. Speeding up the installation process for roof purlins will reduce the number of labor hours required, thereby cutting labor costs. Also importantly, the disclosures set forth above will yield faster project completion. Quicker installation of roof purlins means the overall construction timeline for a building can be shortened. This can be advantageous for meeting project deadlines, especially in situations where time is critical, such as in emergency construction or when working with tight schedules.

The method and system disclosed herein provide for an improvement in overall workflow efficiency on the construction site. The method will allow workers to focus on other tasks sooner, leading to smoother progress throughout the project. Shortening the duration of installation can minimize disruption to other trades or activities happening simultaneously on the construction site. This can help maintain a better flow of work and coordination among different teams. Clients or project owners benefit from reduced construction timelines as it means they can start using or occupying the building sooner. This can translate into cost savings or revenue generation, especially in commercial or rental properties.

While speed is important, it should never compromise safety. The disclosed method and system can speed up installation without sacrificing safety standards, it can be highly beneficial. Shorter installation times mean less exposure to potential hazards for workers. In addition, construction companies that can offer quicker installation times may have a competitive edge in the market. They can potentially win more bids by providing clients with faster project completion without compromising quality. Lastly, the disclosed method for quicker installation of roof purlins is adaptable to different types of buildings and roofing systems and therefore is particularly valuable. It can be used across a range of construction projects, from residential to commercial, providing versatility and scalability.

The disclosed purlin clip, system and method should not be construed as limiting in any way. Instead, the present disclosure is directed toward all novel and nonobvious features and aspects of the various disclosed embodiments, alone and in various combinations and sub-combinations with one another. The disclosed apparatus is not limited to any specific aspect or feature or combination thereof, nor do the disclosed embodiments require that any one or more specific advantages be present, or problems be solved.

In view of the many possible embodiments to which the principles of the disclosed invention may be applied, it should be recognized that the illustrated embodiments are only examples of the disclosure and should not be taken as limiting the scope of the invention. Rather, the scope of the invention is defined by the following claims. I therefore claim as my invention all that comes within the scope of these claims.

The disclosure presented herein is believed to encompass at least one distinct invention with independent utility. While the at least one invention has been disclosed in exemplary forms, the specific embodiments thereof as described and illustrated herein are not to be considered in a limiting sense, as numerous variations are possible. Equivalent changes, modifications, and variations of the variety of embodiments, materials, compositions, and methods may be made within the scope of the present disclosure, achieving substantially similar results. The subject matter of the at least one invention includes all novel and non-obvious combinations and sub-combinations of the various elements, features, functions and/or properties disclosed herein and their equivalents.

Benefits, other advantages, and solutions to problems have been described herein regarding specific embodiments. However, the benefits, advantages, solutions to problems, and any element or combination of elements that may cause any benefits, advantage, or solution to occur or become more pronounced are not to be considered as critical, required, or essential features or elements of any or all the claims of at least one invention.

Many changes and modifications within the scope of the instant disclosure may be made without departing from the spirit thereof, and the one or more inventions described herein include all such modifications. Corresponding structures, materials, acts, and equivalents of all elements in the claims are intended to include any structure, material, or acts for performing the functions in combination with other claim elements as specifically recited. The scope of the one or more inventions should be determined by the appended claims and their legal equivalents, rather than by the examples set forth herein.

Benefits, other advantages, and solutions to problems have been described herein regarding specific embodiments. Furthermore, the connecting lines, if any, shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions.

The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

In the detailed description herein, references to "one embodiment," "an embodiment," "an example embodiment," etc., indicate that the embodiment described may include a feature, structure, or characteristic, but every embodiment may not necessarily include the feature, structure, or characteristic. Moreover, such phrases are not necessarily referring to the same embodiment. Further, when a feature, structure, or characteristic is described relating to an embodiment, it is submitted that it is within the knowledge of one skilled in the art to affect such feature, structure, or characteristic relating to other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention has been described above with reference to one or more preferred embodiments, it will be appreciated that various changes or modifications may be made without departing from the scope of the invention as defined in the appended claims.

I claim:

1. A purlin clip for use in assembling longitudinally overlapping first and second purlins each with keyholes atop a roof beam, the purlin clip comprising:

an upper member with a front face, a rear face, opposed lateral edges, a central opening disposed roughly midway between the opposed lateral edges, and a plurality of attachment openings disposed proximate the opposed lateral edges;

a lower member with an upper face and a lower face, and at least one lower opening configured to receive a fastener for securing the lower member to the roof beam;

an arcuate shaped member connecting the upper member to the lower member, the arcuate-shaped member comprising an indentation to enhance stiffness of the arcuate-shaped member; and a female fastener mounted to the rear face of the upper member and aligned with the central opening, the female fastener configured to receive a male fastener from the front face of the upper member through the central opening such that, when the purlin clip is secured to the roof beam and a keyholed end of one of the purlins rests atop the roof beam, the central opening and female fastener are positioned to allow a portion of the male fastener to extend through a circular opening of the keyhole.

2. The purlin clip of claim 1, wherein the female fastener is at least one of a self-clinching nut and a cage nut.

3. The purlin clip of claim 1, wherein the upper member extends longitudinally approximately three and five times a longitudinal length of the lower member.

4. The purlin clip of claim 1, wherein the central opening is circular and dimensioned such that a fastener received in the female fastener can extend through the central opening and engage a circular opening of a keyhole in one of the purlins.

5. A system for assembling first and second longitudinally overlapping purlins into position without requiring removal of fasteners securing the first purlin into position, the system comprising:

a roof beam;

a purlin clip comprising:

(i) a lower member having at least one opening therein for receiving at least one lower member fastener securing the lower member to the roof beam (ii) an upper member having a front face and a rear face and at least one opening; and (iii) a female fastener secured to the rear face of the upper member and aligned with the at least one opening;

a male fastener extending from the front face of the upper member and threadably engaged with the female fastener;

a first purlin having first and second longitudinally opposed ends and at least one keyhole proximate both the first and second end, the keyholes of the first purlin comprising a circular opening and a slot;

a second purlin with first and second longitudinally opposed ends and at least one keyhole proximate both the first end and second ends, the keyholes of the second purlin comprising a circular opening and a slot;

wherein, in an assembled condition of the system, the male fastener extends through the circular opening of the keyhole proximate the second end of the first purlin, with the second end of the first purlin disposed in the slot of that keyhole such that the first purlin is suspended upon the male fastener and in position against the front face of the purlin clip while also disposed atop the roof beam; and wherein, in a further assembled condition of the system with the second purlin longitudinally overlapping the first purlin, the male fastener extends through the circular opening of the keyhole proximate the first end of the second purlin, with the first end of the second purlin disposed in the slot of that keyhole, such that the male fastener simultaneously supports the second end of the first purlin and the first end of the second purlin in position without removal of the male fastener from the female fastener.

6. The system of claim 5, wherein the first and second purlins each comprise an upper flange and a lower flange, wherein at least one opening is disposed within the lower flange for securing the first and second purlins with a purlin fastener to the roof beam.

7. The system of claim 5, wherein the slot terminus comprises a stop surface oriented transverse to a longitudinal axis of the slot to block further motion of the second purlin when the male fastener is tightened.

8. The system of claim 7, wherein a second male fastener is received into the anchor openings of the first and second purlins and into a second female fastener mounted to the rear face of the upper member over a second opening therein.

9. The system of claim 5, wherein the female fastener member is a nut.

10. The system of claim 5, wherein the male fastener member is a bolt.

11. The system of claim 5, wherein the upper member includes two sets of openings proximate opposed longitudinal edges and an additional set of openings approximately midway between the opposed edges, the openings arranged to locate the male fastener generally centrally between the opposed edges in the installed configuration.

12. A method for assembling first and second overlapping purlins into position upon a roof beam without requiring removal of fasteners securing the first purlin into position, the overlapping purlin assembly comprising:

a purlin clip comprising:

(i) a lower member with at least one opening therein for securing the lower member with at least one lower member fastener member to the roof beam;

(ii) an upper member with a front face and a rear face and at least one opening therein; and (iii) a female fastener secured to the rear face of the upper member, the female fastener disposed concentrically over the at least one opening;

a first purlin with first and second longitudinally opposed ends and at least one keyhole proximate both the first and second end, the keyholes of the first purlin comprising a circular opening and a slot;

a second purlin with a first end and a second end and at least one keyhole proximate both the first end and second end, the keyholes of the second purlin comprising a circular opening and a slot;

a male fastener; and the method comprising:

a) passing the male fastener that is not fully received into the female fastener through the keyhole circular opening of the second end of the first purlin;

b) lowering the second end of the first purlin until the male fastener interferes with the terminus of the slot, thereby restraining the first purlin in position;

c) positioning the second purlin atop the roof beam such that second end of the first purlin laterally offsets but overlaps the first end of the second purlin;

d) passing the male fastener that is not fully received into the female fastener through the keyhole circular opening of the first end of the second purlin;

e) lowering the first end of the second purlin until the male fastener interferes with the terminus of the slot, thereby restraining the second purlin in position; and f) repeating steps (a) through (e) until all purlins are installed upon the roof beam.

13. The method of claim 12, wherein the female fastener is at least one of a self-clinching nut and a cage nut.

14. The method of claim 12, wherein the male fastener is a threaded bolt with a head.

* * * * *